US009512686B2

(12) United States Patent
Kingsley

(10) Patent No.: US 9,512,686 B2
(45) Date of Patent: Dec. 6, 2016

(54) MULTI-SERVICE SUPPLY LINE SYSTEM AND METHOD

(71) Applicant: Tesco Corporation, Houston, TX (US)

(72) Inventor: Alan Ross Kingsley, Calgary (CA)

(73) Assignee: TESCO CORPORATION, Houston, TX (US)

( * ) Notice: Subject to any disclaimer, the term of this patent is extended or adjusted under 35 U.S.C. 154(b) by 651 days.

(21) Appl. No.: 13/804,615

(22) Filed: Mar. 14, 2013

(65) Prior Publication Data

US 2014/0262512 A1 Sep. 18, 2014

(51) Int. Cl.

| | |
|---|---|
| ***E21B 19/08*** | (2006.01) |
| ***E21B 19/02*** | (2006.01) |
| ***F16L 7/02*** | (2006.01) |
| ***E21B 3/02*** | (2006.01) |
| ***E21B 21/00*** | (2006.01) |

(52) U.S. Cl.
CPC ..... *E21B 19/08* (2013.01); *E21B 3/02* (2013.01); *E21B 21/00* (2013.01)

(58) Field of Classification Search
CPC ..... E21B 19/02; E21B 19/08; E21B 19/165; E21B 19/086; E21B 19/04; F16L 7/00; F16L 7/02
See application file for complete search history.

(56) References Cited

U.S. PATENT DOCUMENTS

| | | | | |
|---|---|---|---|---|
| 3,013,108 | A * | 12/1961 | Sweeney | 174/99 R |
| 4,269,226 | A * | 5/1981 | Allread | 137/614 |
| 4,526,228 | A * | 7/1985 | Wynn | E21B 43/121 166/105 |
| 4,872,007 | A * | 10/1989 | Monterosso et al. | 340/870.01 |
| 7,918,270 | B2 | 4/2011 | Schiefelbein, Jr. | |
| 2006/0055175 | A1* | 3/2006 | Grinblat | 290/54 |
| 2006/0201671 | A1* | 9/2006 | Rogers et al. | 166/250.12 |
| 2007/0158076 | A1* | 7/2007 | Hollingsworth et al. | 166/379 |
| 2010/0193198 | A1 | 8/2010 | Murray et al. | |
| 2010/0243324 | A1 | 9/2010 | Veeningen et al. | |
| 2011/0280104 | A1* | 11/2011 | McClung, III | E21B 3/02 367/82 |
| 2013/0314529 | A1* | 11/2013 | Hoffman | 348/82 |
| 2014/0166363 | A1* | 6/2014 | Haci | E21B 44/00 175/24 |

FOREIGN PATENT DOCUMENTS

| | | |
|---|---|---|
| EP | 1961913 | 8/2008 |

OTHER PUBLICATIONS

International Search Report & Written Opinion for International Application No. PCT/US2014/020394 mailed Dec. 4, 2014.
Bentec GmbH Drilling & Oilfield Systems, "Technical Bulletin Top Drive TD-500-HT Top Drive TD-350 HT," dated Apr. 19, 2011, Bad Bentheim, Germany, URL: http://drillzone.ru/uploads/files/18476723584dad37f38b896.pdf, retrieved Jan. 20, 2015, 33 pgs.

* cited by examiner

*Primary Examiner* — Kipp Wallace
(74) *Attorney, Agent, or Firm* — Fletcher Yoder, P.C.

(57) ABSTRACT

Present embodiments are directed toward a drilling system that includes a conduit configured to route a pressurized gas to a top drive of a drilling rig. The drilling system also includes one or more cables disposed in the conduit. The one or more cables are configured to provide communication, power, or both, to the top drive.

16 Claims, 3 Drawing Sheets

MULTI-SERVICE SUPPLY LINE SYSTEM AND METHOD

BACKGROUND

Embodiments of the present disclosure relate generally to the field of drilling and processing of wells. More particularly, present embodiments relate to a system and method for delivering services to equipment such as a top drive of a drilling rig.

In conventional oil and gas operations, a well is typically drilled to a desired depth with a drill string, which includes drillpipe, drill collars and a bottom hole drilling assembly. During a drilling process, the drill string may be turned by a top drive, which uses one or more motors to turn a quill coupled to the upper tubular of the drill string. The top drive is typically suspended from a traveling block above the rig floor so that it may be raised and lowered throughout drilling operations.

In conventional operations, a service loop with multiple supply lines provides services to the top drive from components located about the drilling rig. For example, hydraulic top drives typically receive hydraulic fluid and pressurized gases from a hydraulic unit of the rig via separate conduits. Similarly, the top drive typically receives electrical power and communication from rig components via insulated cables. In general, each supply line includes a separate insulated cable or conduit for providing a single service to the top drive.

Due to environments typically experienced on the drilling rig, the supply lines are often heavily insulated to prevent conduit leaks or cable damage. Such insulation contributes to an overall weight of the multiple supply lines of the service loop. It is now recognized that this weight can make the service loop difficult to manipulate about the drilling rig and that the use of multiple separate supply lines to convey services to the top drive can lead to cable entanglements. Accordingly, it is now recognized that these traditional service supply techniques are inefficient and there exists a need for a system and method for providing multiple services from rig components to a top drive without the use of separate cables and conduits.

BRIEF DESCRIPTION

Present embodiments are designed to respond to such a need. In accordance with one aspect of the invention, a drilling system includes a conduit configured to route a pressurized gas to a top drive of a drilling rig. The drilling system also includes one or more cables disposed in the conduit. The one or more cables are configured to provide communication, power, or both, to the top drive and other equipment.

In accordance with another aspect of the disclosed embodiments, a drilling system includes a single multiservice supply line. The multiservice supply line is configured to deliver pressurized gas and at least one other service to a top drive of a drilling rig from one or more units disposed about the drilling rig. The at least one service includes power, communication, or both.

Present embodiments also provide a method for providing services to a top drive from one or more drilling rig components. In an embodiment, the method includes routing pressurized gas to a top drive of a drilling rig via a conduit connected to a hydraulic unit of the drilling rig. The method also includes providing communication, power, or both, to the top drive via cables disposed in the conduit

DRAWINGS

These and other features, aspects, and advantages of the present embodiments will become better understood when the following detailed description is read with reference to the accompanying drawings in which like characters represent like parts throughout the drawings, wherein.

DETAILED DESCRIPTION

Presently disclosed embodiments are directed toward a novel system and method for supplying electricity, gas, and other services to a top drive during casing and drilling operations. The embodiments specifically described below include a drilling rig equipped with a multiservice supply line that runs from components along a rig floor to the elevated top drive. However, embodiments of the present disclosure may utilize the multiservice supply line to provide multiple services to other types of equipment as well.

The multiservice supply line may provide a unified service-way for communication, power, air, and other gases that facilitate desired operation of the top drive. In some embodiments, the multiservice supply line includes a rugged pressurized hose, and this hose functions as a reservoir which can supply an immediate and large quantity of pressurized gas to the top drive as desired. Power, communication, or both may be provided to the top drive via cables that are enclosed within the pressurized hose and surrounded by the pressurized gas. The cables and pressurized gas, which in typical systems are directed through separate supply lines, are provided together in the disclosed multiservice supply line. The multiservice supply line provides the pressurized gas to the top drive while simultaneously providing mechanical protection to the cables via the casing of the multiservice supply line and the pressurized gas therein. Because of the added protection, lighter cables may be used, increasing the maneuverability of the multiservice supply line. In addition, cable management may be improved through the consolidation of the different services into a single multiservice supply line.

Figure 1:
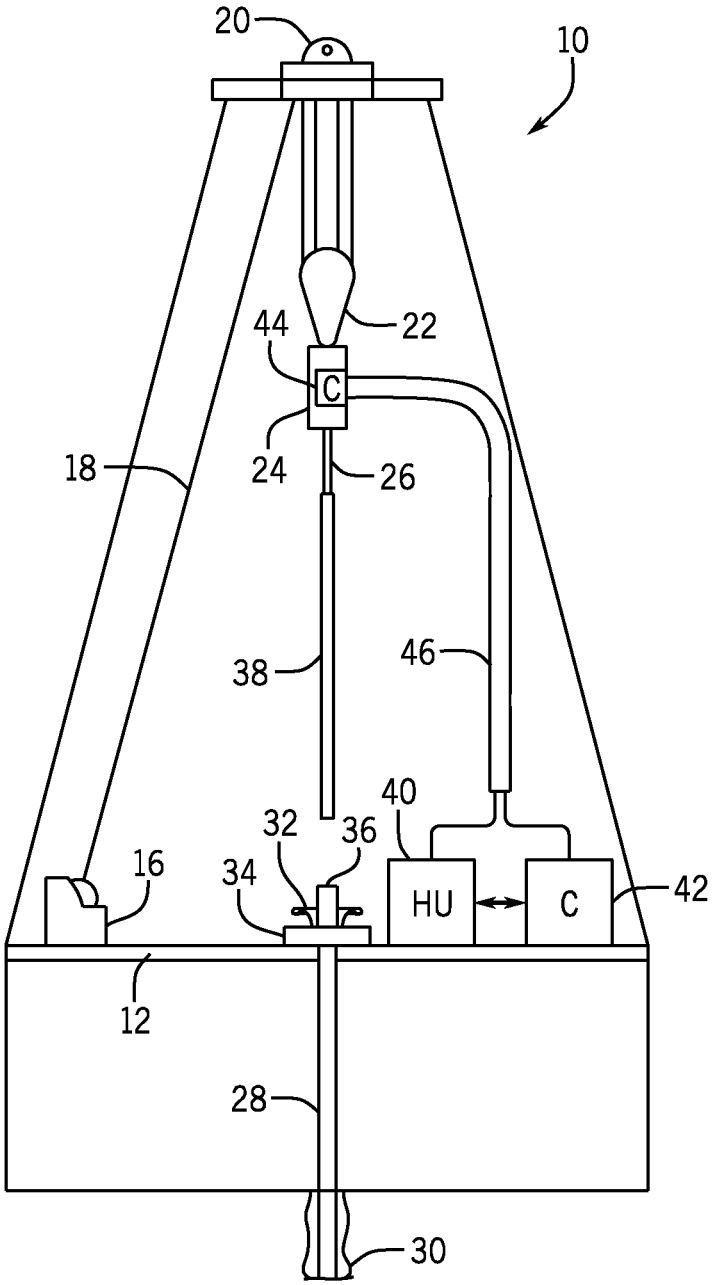
FIG. 1 is a schematic representation of a well being drilled in accordance with an embodiment of the present techniques.

Turning now to the drawings, FIG. 1 is a schematic representation of a drilling rig 10 in the process of drilling a well in accordance embodiments of the present techniques. The drilling rig 10 features an elevated rig floor 12 and a derrick 14 extending above the elevated rig floor 12. A supply reel 16, which may include a winch or draw works, supplies drilling line 18 to a crown block 20 and traveling block 22 in order to hoist various types of drilling equipment above the rig floor 12. The traveling block 22 supports a top drive 24, which features a quill 26 used to turn tubular or other drilling equipment. Below the rig floor 12, a tubular string 28 extends downward into a wellbore 30 and is held stationary with respect to the rig floor 12 by a spider or slips 32 of a rotary table 34. A portion of the tubular string 28 extends above the rig floor 12, forming a stump 36 to which another tubular element 38 (e.g., a joint of drillpipe) is in the process of being added.

In some embodiments, the drilling rig 10 may include a hydraulic unit 40 and a control unit 42 (driller's panel), each located at or near the rig floor 12. The hydraulic unit 40 may include one or more hydraulic pumps configured to send hydraulic flow through a closed loop to the motor(s) of the top drive 24 to facilitate rotation of the quill 26. The hydraulic unit 40 also may include principle control components that communicate with a control panel 44 of the top drive 24. These control components may be configured to operate specifically with the top drive 24 present on the drilling rig 10. That is, the hydraulic unit 40 may receive control instructions from the control unit 42 operated by a driller, and determine appropriate control signals to send to the top drive 24. The top drive 24 may also be in direct communication with the control unit 42 near the rig floor 12. In addition to communication, the hydraulic unit 40 may provide electrical power and/or pressurized gas to the top drive 24 during certain drilling operations.

Present embodiments of the drilling rig 10 include a multiservice supply line 46 configured to deliver pressurized gas and at least one other service to the top drive 24 from the hydraulic unit 40 and/or from the control unit 42. The pressurized gas may be air or another inert or protective gas. The services may include communication, power, or both. The multiservice supply line 46 may include cabling to deliver the at least one service, the cabling being enclosed in a conduit. The pressurized gas is delivered through the conduit, surrounding and protecting the cabling contained in the conduit. In this way, the multiservice supply line 46 functions as an umbilical cord to provide multiple services, including pressurized gas and communication, power, or both, to the top drive 24. In some embodiments, additional runs of hydraulic fluid, air, or other gases may be provided to the top drive 24 through additional conduits contained in the multiservice supply line 46.

It should be noted that the drilling rig 10 illustrated in FIG. 1 is intentionally simplified to focus on the multiservice supply line 46 described in the present disclosure. Many other components and tools may be employed during the various periods of formation and preparation of the wellbore 30. Similarly, the environment of the wellbore 30 may vary widely depending upon the location and situation of the formations of interest. For example, rather than a surface (land-based) operation, the wellbore 30 may be formed under water of various depths, in which case the topside equipment may include an anchored or floating platform.

Figure 2:
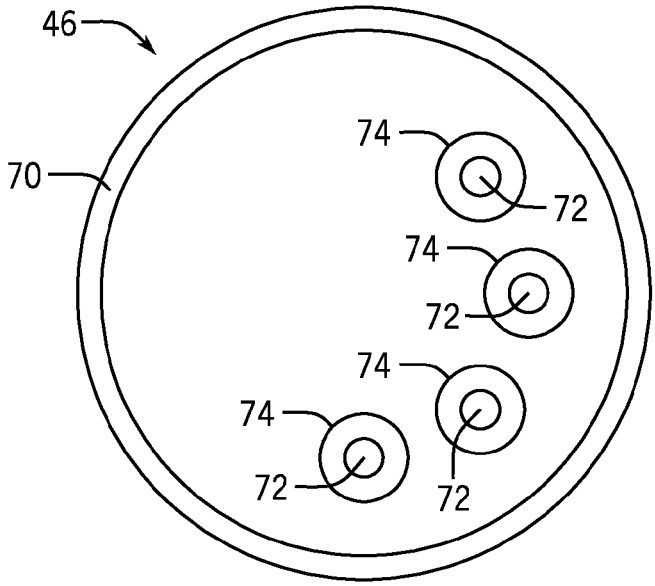
FIG. 2 is a cross sectional view of a multiservice supply line used to route services to a top drive in accordance with an embodiment of the present techniques.

FIG. 2 is a cross-sectional view of the multiservice supply line 46 used to route services to the top drive 24. As noted above, the multiservice supply line 46 includes a conduit 70 configured to route a pressurized gas to the top drive 24. The conduit 70 may include, in certain embodiments, a pressurized hose. The casing or wall of the pressurized hose may be suitably rugged for protecting the enclosed supply lines from a potentially harsh environment of the drilling rig 10. In this way, the hose may provide mechanical protection of the enclosed cables or conduits delivering services to the top drive 24.

Inside the conduit 70, the multiservice supply line 46 includes four service lines 72 for providing one or more services to one or more locations in the top drive 24. It should be noted that any desirable number and arrangement of service lines 72 may be provided from components about the drilling rig 10 to the top drive 24 via the multiservice supply line 46. For example, the service lines 72 may include cables for delivering communication and/or power. Such cables may include a fiber optic, Ethernet, or other desirable communication cable for delivering signals between a rig component (e.g., hydraulic unit 40 or control unit 42) and the top drive 24. Additionally, the service lines 72 may include one or more copper cables for delivering power to a component of the top drive 24. The multiservice supply line 46 may deliver this power for operating valves or other control mechanisms of the top drive 24.

In addition to power and communication, the service lines 72 may include one or more separate conduits (e.g., hydraulic line, gas line, etc.) configured to deliver hydraulic fluid or a separate supply of gas to the top drive 24. For example, the conduit 70 may provide a pressurized gas to the top drive 24 via the central passage formed by the conduit 70 as desired, while one of the service lines 72 provides a hydraulic fluid or an isolated gas flow to the top drive 24. The top drive 24 may receive the separate fluid or gas flows via the multiservice supply line 46 at different locations of the top drive 24 and may perform different functions in the top drive 24. For example, the multiservice supply line 46 may provide hydraulic fluid from the hydraulic unit 40 to the top drive 24 through one of the service lines 72 in the conduit 70. The hydraulic fluid may enter a hydraulic flow line of the top drive 24 to actuate one or more mechanisms of the top drive 24, while the pressurized gas flowing through the conduit 70 (around the service lines 72) may be delivered to the control panel 44 to purge the control panel 44 of residual gases. Any other desirable services may be supplied to the top drive 24 from one or more units located about the drilling rig 10 via the single multiservice supply line 46.

The multiservice supply line 46 may provide appropriate protection to the power, communication, gas, and other services provided to the top drive 24 while maintaining a reduced weight of the service loop. The cables and the conduits that make up the service lines 72 may each include a protective layer 74 (e.g., insulation, rugged hose) to protect the service lines 72 from outside contaminants, mechanical forces, and the like. The pressurized gas flowing through the conduit 70 may provide an additional amount of protection to the service lines 72 contained in the conduit 70. Specifically, the pressurized gas may buffer mechanical impacts to the conduit 70 to reduce any mechanical force that may otherwise damage the service lines 72. For example, the pressure inside the conduit 70 may be maintained at a level sufficient to resist kinking or crushing. In addition, the pressurized gas may reduce ingress of liquids (e.g., water) into the multiservice supply line 46, so that the liquid does not deteriorate the protective layers 74. Because of the additional protection offered by the pressurized gas, the protective layers 74 of the service lines 72 may be lighter and less rugged than those used to protect separate service lines located outside the pressurized conduit 70. The multiservice supply line 46 may weigh less than traditional service loops used to transport communication, power, and other such services to the top drive 24. This may increase maneuverability of the services provided to the top drive 24 and reduce a force on support structures of the drilling rig 10.

Figure 3:
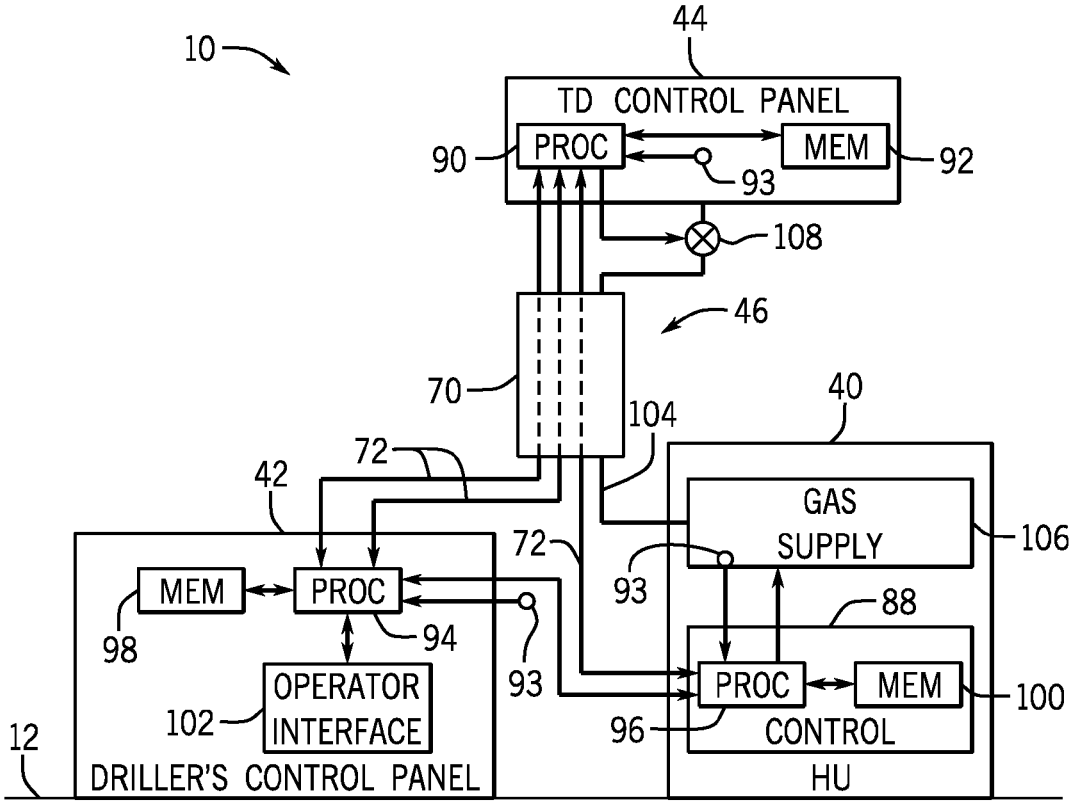
FIG. 3 is a block diagram of a top drive control component interacting with other components about a drilling rig via a multiservice supply line in accordance with an embodiment of the present techniques.

FIG. 3 is a block diagram of the top drive control panel 44 interacting with other components of the drilling rig 10 via the multiservice supply line 46. The control panel 44 may be in communication with one or more components located about the drilling rig 10, such as the hydraulic unit 40 and the control unit 42 disposed on the rig floor 12. More specifically, the control panel 44, a controller 88 of the hydraulic unit 40, and the control unit 42 may be connected with each other, providing control signals, sensor feedback, electrical power, and other services to each other to perform various rig operations. These electrical services may be directed between the different control components of the rig via cabling (service lines 72). The multiservice supply line 46 provides a unified service way for directing such communication and power between components near the rig floor 12 and the top drive 24.

The control panel 44 may include a processor 90 and a memory 92. The processor 90 may receive various inputs from other rig components, such as control signals or feedback from one or more sensors 93 located about the drilling rig 10. In addition, the processor 90 may be operably coupled to the memory 92 or another storage component to execute instructions for carrying out operational functions of the top drive 24. Such functions may include turning the quill 26, stabbing or otherwise engaging tubular, actuating tilt mechanisms, operating elevators, opening and closing valves, purging the control panel 44 of gases, and so forth. These instructions may be encoded in programs that may be executed by the processor 90 to control the top drive 24 in an appropriate manner. The codes may be stored in any suitable article of manufacture that includes at least one tangible non-transitory, computer-readable medium (e.g., a hard drive) that at least collectively stores these instructions or routines, such as the memory 92. Similarly, the control unit 42 and the controller 88 of the hydraulic unit 40 may each include respective processors 94 and 96 for executing machine-readable instructions stored in respective memories 98 and 100. The control unit 42 may include an operator interface 102 through which a driller may input commands for operating rig components (e.g., top drive 24) and receive outputs indicating the operational state of the drilling rig 10.

It may be desirable to provide a pressurized gas 104 directly to the control panel 44 of the top drive 24. For example, a purge system may be configured to receive the pressurized gas from the multiservice supply line 46 and purge the control panel 44 of residual gases. In some embodiments, the purge system may be part of the top drive 24, so that the multiservice supply line 46 provides the pressurized gas 104 to the top drive 24 and the top drive 24 routes the pressurized gas 104 to purge the control panel 44 of residual gases. This purge operation may be provided at regular intervals or as a step immediately prior to providing electrical power to certain top drive control components. This regular purge may facilitate and maintain desirable operating conditions within the top drive 24. In other embodiments, the pressurized gas 104 may be delivered to the top drive 24 to maintain a positive pressure around the control panel 44. For example, the multiservice supply line 46 may provide a trickle purge of the pressurized gas 104 from the conduit 70 to the control panel 44 throughout operation of the drilling rig 10. A pressure sensor (e.g., sensor 93) in the top drive 24 may monitor the positive pressure in the control panel 44 and transmit the sensed pressure to the processor 90. The processor 90 may communicate signals indicative of the pressure to the other processors 94 and 96 via service lines 72 for various monitoring and control operations. The pressurized gas 104 may be provided to the control panel 44 at a certain temperature, pressure, concentration, or other parameter for maintaining a desired environment within the control panel 44, increasing the reliability and controllability of the top drive 24.

The multiservice supply line 46 may provide the pressurized gas 104 to the top drive 24 for this control panel purge. In some embodiments, the multiservice supply line 46 may direct the pressurized gas 104 from a gas supply 106 located on or near the drilling rig 10 to the top drive 24. For example, in the illustrated embodiment the pressurized gas 104 is supplied via a gas supply 106 that is part of the hydraulic unit 40. The gas supply 106 may represent a system that draws gas from the atmosphere or a storage tank, and pressurizes the gas via a compressor. The pressurized gas 104 flows toward the top drive 24 through the conduit 70 of the multiservice supply line 46, protecting the service lines 72 that run through the conduit 70. The conduit 70 may function as a reservoir or gas supply for the pressurized gas 104, such that one or more valves 108 or quick release fittings (integrated with the conduit 70) are actuated to output the pressurized gas 104 to the top drive 24 as desired. In this way, the multiservice supply line 46 may intermittently provide a portion of the pressurized gas 104 stored therein to the top drive 24. Check valves between the gas supply 106 and the conduit 70 may be used to maintain the air supply in the multiservice supply line 46 so that the service lines 72 are consistently surrounded by the pressurized gas 104 at a desired pressure.

Figure 4:
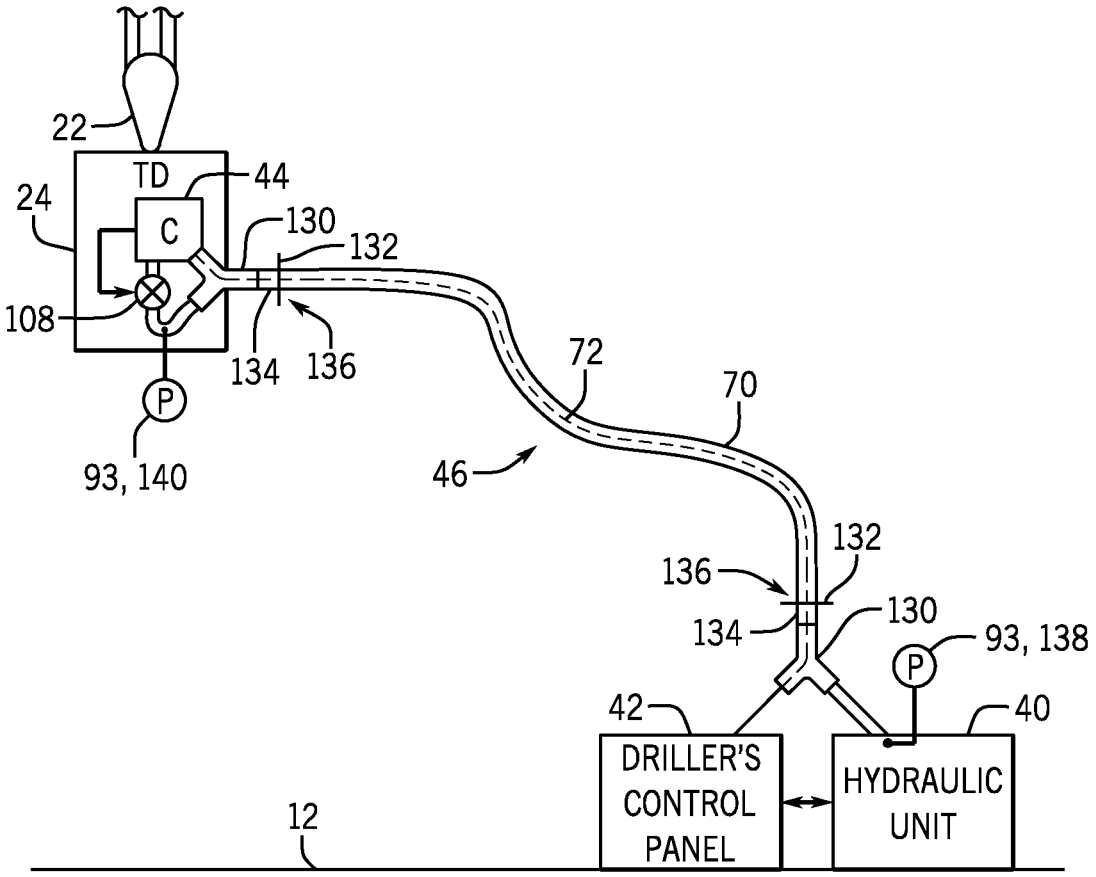
FIG. 4 is a schematic representation of a multiservice supply line providing services from units on a rig floor to a top drive in accordance with an embodiment of the present techniques.

FIG. 4 is a schematic representation of the multiservice supply line 46 providing services from the hydraulic unit 40 and the control unit 42 to the top drive 24. The multiservice supply line 46 may include connectors 130 at one or both ends of the multiservice supply line 46, in order to direct different services in different directions. Such connectors 130 may help direct services to or from multiple locations near the rig floor 12, as well as multiple locations within the top drive 24. The multiservice supply line 46 (e.g., the combined conduit 70 and service lines 72) may be coupled to the top drive 24 via the connector 130, which is configured to route the pressurized gas and communication, power, or other services to features of the top drive 24. In the illustrated embodiment, the connectors 130 include Y-adapters configured to provide access to the pressurized gas via a first passage and to provide access to the service lines 72 via a second passage. A plugging feature of the connector 130 may block the pressurized gas from flowing through the second passage. Other embodiments may include different types of multi-faceted connection features to provide different combinations of the services to and from appropriate locations of the top drive 24 and other rig components.

Depending on the size, type, and arrangement of the drilling rig 10, the multiservice supply line 46 may be any desired length. For example, in some embodiments a portion of the multiservice supply line 46 that contains the pressurized gas (e.g., conduit 70) may be approximately seventy meters in length. Portions of the multiservice supply line 46 of this length, or a comparable length, may encounter a certain amount of strain at different points throughout rig operations. This strain may result from vertical movement of the top drive 24 via the travelling block 22, or from the multiservice supply line 46 catching on equipment located about the drilling rig 10. In such instances, it may be desirable to disable the drive with an interlock device or release the strain from the multiservice supply line 46 when the strain reaches a threshold, to improve the life of the service lines 72.

The multiservice supply line 46 may be configured to decouple from a fixed point 132 at one or both ends. The fixed points 132 may form one end of each connector 130. That is, the conduit 70 and the service lines 72 located therein may be configured to decouple from the connector 130 when the conduit 70 is pulled beyond a threshold, while the connector 130 maintains a coupling with the top drive 24. Both the conduit 70 and the enclosed service lines 72 may be decoupled at one of these points 132 when the strain on the multiservice supply line 46 reaches the threshold. In some embodiments, the connector 130 may include an emergency switch 134 that is activated upon the pulling of the multiservice supply line 46 at the strain threshold. Upon activation, the emergency switch 134 may facilitate a smooth breakaway of the multiservice supply line 46 from one of the points 132. In addition, the emergency switch 134 may send a signal to one or more control components about the drilling rig 10 to indicate the disconnection of the multiservice supply line 46. In other embodiments, the control components (e.g., control panel 44, control unit 42, and hydraulic unit 40) may be configured to determine when the connection is lost based on the loss of power or communication between the components, or a sudden pressure drop.

In some embodiments, the multiservice supply line 46 may include one or more swivel fitting connections 136 configured to reduce a strain on the service lines 72. The swivel fitting connections 136 may include any type of connection that allows the conduit 70 to rotate with respect to its centerline. In some embodiments, the swivel fitting connections 136 may include a connection that directs the service lines 72 into a concentric arrangement at the swivel fitting. In this way, the service lines 72 may be rotated with respect to the centerline as well. The swivel fitting connections 136 may provide strain relief and cable management for the multiservice supply line 46. Specifically, the multiservice supply line 46 may be looped about itself when slack is brought to the line, such as when the top drive 24 is lowered toward the rig floor 12. When the top drive 24 is raised again, the multiservice supply line 46 may unfold without any undesirable strain on the service lines 72 or the conduit 70 because of the rotated multiservice supply line 46.

As noted above, the control components (e.g., control panel 44, control unit 42, controller 88) of the drilling rig 10 may receive inputs from sensors 93 located about the drilling rig 10 for monitoring various operating parameters of the drilling rig 10. In the illustrated embodiment, these sensors 93 include an upstream pressure sensor 138 located upstream of the multiservice supply line 46 and a downstream pressure sensor 140 located downstream of the multiservice supply line 46. Each of the pressure sensors 138 and 140 may be configured to sense a pressure of the pressurized gas 104 at the different points relative to the multiservice supply line 46.

A control component of the drilling rig may process signals from the pressure sensors 138 and 140 to determine a pressure drop along the length of the multiservice supply line 46. It may be possible to monitor the health and integrity of the multiservice supply line 46 by continually monitoring the pressure drop through the multiservice supply line 46. For example, if a sudden and unexpected pressure drop is detected via the pressure sensors 138 and 140, a control/monitoring device of the drilling rig 10 may determine that maintenance is needed on the multiservice supply line 46, based on the pressure drop. Accordingly, the driller's control panel 44 may alert an operator to indicate the presence of a leak in the conduit 70. Any sensors 93 disposed in or around the multiservice supply line 46 may be configured to communicate signals to one or more of the control panel 44, the control unit 42, or the hydraulic unit 40 via cables routed through the multiservice supply line 46. In other embodiments, the sensors 93 may be configured to communicate wirelessly with one or more of the control components located about the drilling rig 10.

While the present disclosure may be susceptible to various modifications and alternative forms, specific embodiments have been shown by way of example in the drawings and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A drilling system, comprising:

a top drive of a drilling rig, wherein the top drive comprises a top drive control panel;

a conduit configured to be filled with, contain, and route a pressurized gas to the top drive; and one or more cables disposed in the conduit and configured to deliver communication, electrical power, or both, to the top drive, wherein the top drive is configured to route the pressurized gas to purge the top drive control panel of residual gas.

2. The drilling system of claim 1, wherein the conduit and the cables are configured to be coupled to the top drive via a connection feature, wherein the connection feature is configured to route the pressurized gas and the communication, electrical power, or both, to features of the top drive.

3. The drilling system of claim 2, wherein the conduit and the one or more cables are configured to decouple from the connection feature when the conduit is pulled beyond a threshold, while the connection feature maintains a coupling with the top drive.

4. The drilling system of claim 1, comprising a gas line disposed in the conduit and configured to provide a separate supply of gas to the top drive.

5. The drilling system of claim 1, wherein the cables comprise at least one of an Ethernet cable, a power cable, or a fiber optic cable.

6. The drilling system of claim 1, comprising a quick release fitting integrated with the conduit.

7. The drilling system of claim 1, wherein the conduit comprises one or more swivel connectors configured to reduce a strain on the one or more cables.

8. The drilling system of claim 1, comprising a control/monitoring device configured to monitor a pressure drop through the conduit via pressure sensors disposed upstream of the conduit, downstream of the conduit, or along the conduit.

9. A drilling system, comprising:

a top drive of a drilling rig, wherein the top drive comprises a top drive control panel; and a single multiservice supply line configured to be filled with, contain, and deliver pressurized gas and deliver at least one other service to the top drive of the drilling rig from one or more units disposed about the drilling rig, wherein the at least one other service comprises electrical power, communication, or both, and wherein the top drive is configured to route the pressurized gas to purge the top drive control panel of residual gas.

10. The drilling system of claim 9, wherein the multiservice supply line comprises cabling to deliver the at least one service, wherein the cabling is enclosed in a conduit with the pressurized gas delivered through the conduit.

11. The drilling system of claim 9, wherein the top drive is configured to receive the electrical power from the multiservice supply line and deliver the electrical power to valves or other control mechanisms of the top drive.

12. The drilling system of claim 9, comprising an adapter coupled to an end of the multiservice supply line and configured to provide access to the pressurized gas via a first passage and access to the electrical power, communication, or both via a second passage.

13. A method, comprising:

routing pressurized gas to a top drive of a drilling rig via a conduit connected to a hydraulic unit of the drilling rig;

providing communication, electrical power, or both, to the top drive via cables disposed in the conduit, routing the pressurized gas through the top drive to purge a top drive control panel of residual gas.

14. The method of claim 13, comprising providing a separate supply of gas to the top drive via an isolated gas line disposed in the conduit.

15. The method of claim 13, comprising monitoring a pressure drop through the conduit to determine whether maintenance is needed on the conduit.

16. The method of claim 13, comprising maintaining a supply of the pressurized gas in the conduit and intermittently providing a portion of the pressurized gas to the top drive.

* * * * *